US006482096B1

(12) United States Patent
Rieber et al.

(10) Patent No.: US 6,482,096 B1
(45) Date of Patent: Nov. 19, 2002

(54) SWING RIDE WITH BUBBLE GENERATOR

(75) Inventors: Frederick M. Rieber, Alum Bank, PA (US); Steven P. Hanson, North Kingstown, RI (US)

(73) Assignee: Hedstrom Corporation, Bedford, PA (US)

( * ) Notice: Subject to any disclaimer, the term of this patent is extended or adjusted under 35 U.S.C. 154(b) by 0 days.

(21) Appl. No.: 09/981,116

(22) Filed: Dec. 13, 2001

(51) Int. Cl.[7] ..... A63G 9/00
(52) U.S. Cl. ..... 472/118; 472/125
(58) Field of Search ..... 472/118, 119, 472/120, 121, 122, 123, 124, 125

(56) References Cited

U.S. PATENT DOCUMENTS 3,539,181 A * 11/1970 Larsen ..... 472/118
4,299,049 A * 11/1981 Pimentel et al. ..... 446/15
5,042,819 A * 8/1991 LaFata ..... 273/349
5,224,902 A * 7/1993 Stremler ..... 297/245
5,261,850 A * 11/1993 Barthold ..... 446/180
5,505,664 A * 4/1996 Nolan et al. ..... 297/245
5,522,756 A * 6/1996 Barthold ..... 446/193
5,975,358 A * 11/1999 Zheng et al. ..... 222/79

* cited by examiner

*Primary Examiner*—Kien T. Nguyen
(74) *Attorney, Agent, or Firm*—Cesari & McKenna, LLP

(57) ABSTRACT

A swing ride capable of swinging motion about an elevated support. The swing ride includes first and second parts which move toward and away from one another during the swinging motion of the swing and a deformable chamber which is alternately compressed and expanded during the periodic motion of the swing. A fluidically operated toy is connected to one of the parts and a fluid conduit is connected between the deformable chamber and the toy to conduct fluid between the deformable chamber and the toy so that the toy is energized by a change in fluid pressure from the deformable chamber caused by the swinging motion of the swing ride.

8 Claims, 2 Drawing Sheets

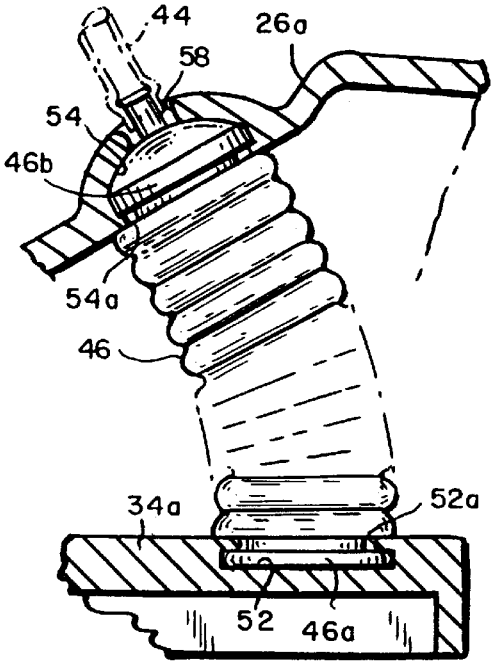
FIG. 2
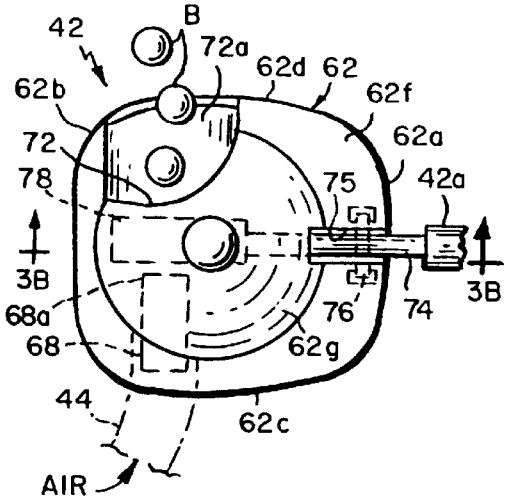
FIG. 3A
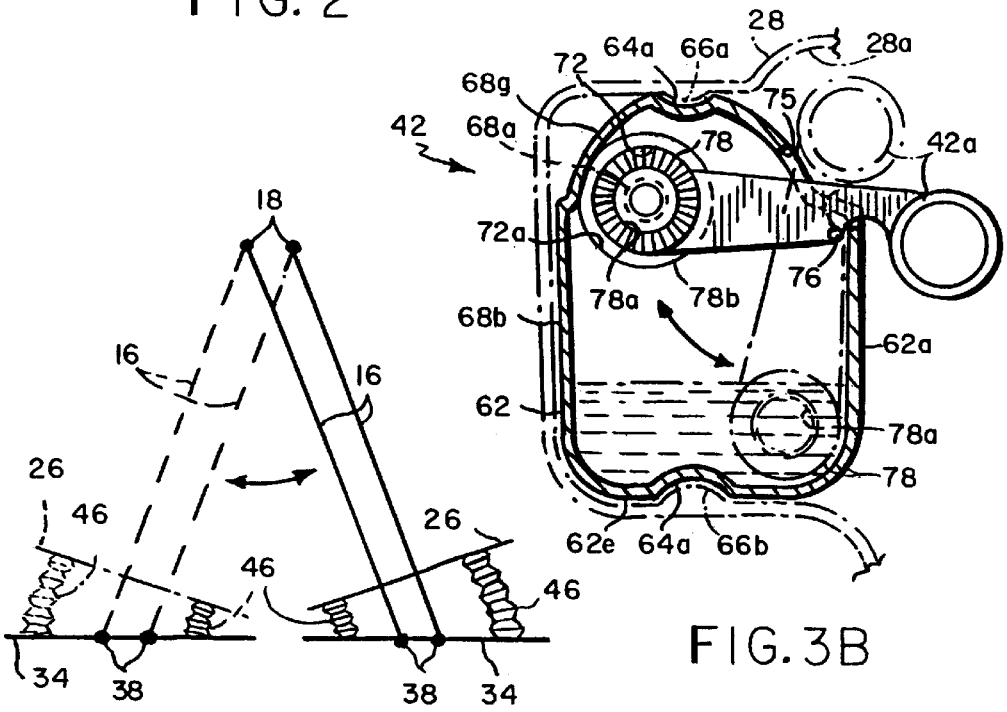
FIG. 3B
FIG. 4

SWING RIDE WITH BUBBLE GENERATOR

This invention relates to children's play rides of the type commonly associated with children's swing sets, play gyms and the like. It relates especially to a swing referred to as a glide ride.

BACKGROUND OF THE INVENTION

A glide ride is a type of swing having a platform which is pivotally suspended from an elevated support by one or more pairs of parallel elongated hangers. The lower ends of the hangers of each pair are pivotally connected to the platform at spaced-apart locations thereon and the upper ends of the hangers of each pair are pivotally connected to the support. When the ride is swung back and forth relative to the support, the platform defines varying angles with its supporting hangers. The prior art is replete with examples of such swings, one old example being a conventional lawn swing. Other more recent examples are those marketed by Hedstrom Corporation, Bedford, Pennsylvania, under the trademarks STAR CRUISER and BUMP'N GLIDE.

While such swing rides have provided considerable enjoyment to children, it would be desirable to be able to provide an added measure of enjoyment to the occupants of such swings.

SUMMARY OF THE INVENTION

Accordingly, it is an object of the present invention to provide an improved swing ride for children.

Another object of the invention is to provide such a swing ride incorporating a toy which can be operated by the children in association with the ride.

Another object of the invention is to provide a swing ride incorporating a toy whose operation depends upon the swinging motion of the swing ride.

A further object of the invention is to provide a swing ride/toy combination which is relatively inexpensive to make in quantity.

Still another object of the invention is to provide the aforesaid combination which can be assembled relatively easily by the consumer.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

We will describe the invention in the context of a glide ride-type of children's swing. It should be understood however, that the invention is equally applicable to other swings whose swinging motion causes one component of the swing to move relative to another component thereof.

Basically a typical glide ride includes a horizontal platform which is supported above the ground by a pair of spaced-apart parallel hangers which are suspended from an overhead support such as the crossbar of a children's swing set. The hangers are pivotally connected to the platform and to the support such that when the glide ride swings back and forth the platform remains substantially horizontal while the parallel hangers swing to various angles relative to the horizontal. In other words, the two angles defined by the platform and the two hangers vary with the swinging motion, and in fact, the two angles vary in a reciprocal manner.

In some cases, glide rides of this type have mirror image seat structures supported by the hangers above the platform which structures move with the hangers so that the included angle between each seat structure and the platform also changes with the swinging motion in a reciprocal manner.

In accordance with the present invention, a deformable chamber is captured between the platform and at least one of the seat structures. An outlet tube extends from the interior of that chamber to a toy mounted to the seat structure. Each deformable member is alternately extended and compressed by the relative motion of the seating structure and platform due to the swinging motion of the swing. Each time a deformable chamber is compressed, it delivers a fluid such as air or water via a connecting tube to energize the toy. The toy is activated by a rider moving a trigger associated with the toy.

In the present glide ride, the toy is a bubble generator to be described in more detail later. Suffice to say here that the bubble generator has a reservoir of a soapy liquid and a trigger which, when pulled, moves a ring from within the liquid to a location opposite to the distal end of the aforesaid tube from the deformable chamber. If the timing of the trigger pull coincides with the compression of the deformable chamber, a puff of air from the tube impinges upon the soap film spanning the ring causing one or more bubbles to be propelled into the air by the bubble generator.

Thus, each of the two riders on the swing has to coordinate the activation of his/her bubble generator with the motion of the swing in order to generate bubbles, thus adding considerable interest to the swing ride. For a glide ride with two bubble generators, only one generator at a time can produce bubbles, i.e. the one whose deformable chamber is under compression and only if the rider pulls the trigger of that generator.

As we shall see, the deformable members and the bubble generators are relatively simple manufactured articles which can be assembled to the associated swing ride quite easily without requiring any special tools. Therefore, the swing ride can be sold in a knock down condition and assembled easily by the consumer.

BRIEF DESCRIPTION OF THE DRAWINGS

For a fuller understanding of the nature and objects of the invention, reference should be made to the following detailed description taken in connection with the accompanying drawings, in which:

FIG. 2 is a fragmentary sectional view on a larger scale showing part of the bubble generator on the FIG. 1 swing ride;

FIG. 3A is a plan view of another part of the bubble generator on the FIG. 1 swing ride;

FIG. 3B is a sectional view taken along line 3B—3B of FIG. 3A, and FIG. 4 is a schematic diagram showing the operation of the FIG. 1 swing ride.

DESCRIPTION OF THE PREFERRED EMBODIMENT

Figure 1:
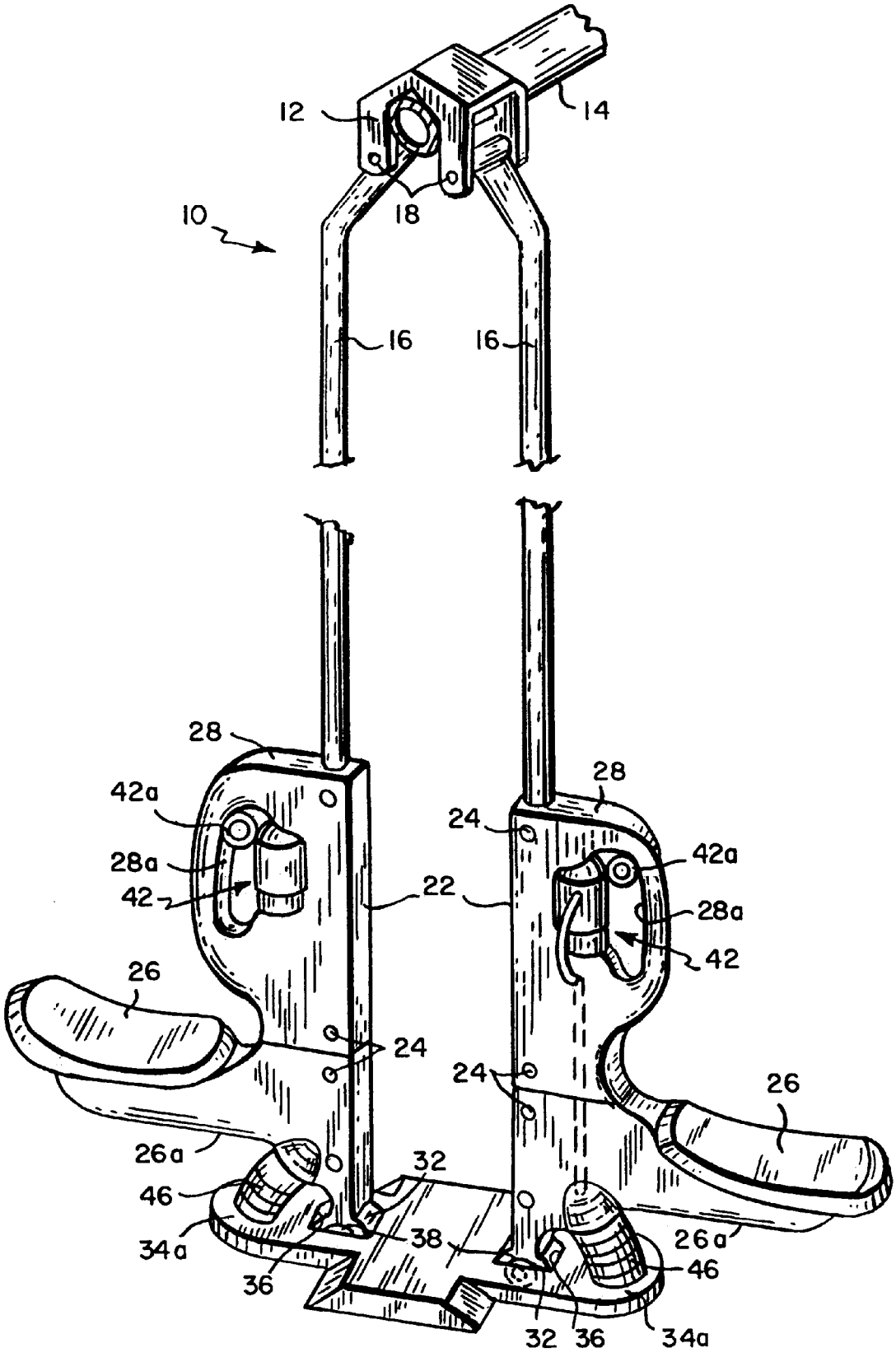
FIG. 1 is an isometric view of a swing ride with bubble generator incorporating the invention.

Referring to FIG. 1 of the drawings, our swing ride shown generally at 10 is suspended by way of a bracket 12 from an elevated support 14 which may be the crossbar of a children's swing set. Swing ride 10 includes a pair of spaced-apart, parallel, mirror image hangers 16 whose upper ends are inturned and connected by pivots 18 to bracket 12 at spaced apart locations thereon at opposite sides of support 14. As is conventional in swing rides of this type, pivots 18 define a horizontal plane.

Suspended from hanger 16 is a pair of mirror image seat structures 22 which are secured to their respective hangers by fasteners 24. Seat structures 22 define seats 26 midway down on those structures and handles 28 at the tops of the structures, each handle defining a handle opening 28*a*.

Still referring to FIG. 1, the lower end of each seat structure 22 defines an eye 32 which is pivotally connected to a horizontal platform in the form of a footrest 34. More particularly, footrest 34 has a pair of openings 36 spaced along its length which are sized to receive the eyes 32. Pivot pins 38 extend through those eyes with the opposite ends of the pins being secured to footrest 34. The pivot pins are spaced apart along the longitudinal axis of the foot rest 34 such that hangers 16 are parallel so that when the hangers are swung about their pivots 18, and hangers 16 remain parallel to one another shifting axially as needed to maintain the footrest 34 more or less parallel to the ground. Seat structures 22 being secured to their respective hangers 16 also swing relative to footrest 34. Therefore, as the hangers 16 swing back and forth, the included angles between seats 26 and footrest 34 vary in a reciprocal manner as shown in FIG. 4. In other words, when the FIG. 1 ride swings to the right, the included angle between the right-hand seat 26 and footrest 34 increases while the included angle between the left-hand seat 26 and the footrest decreases. On the other hand, when that ride swings to the left, the angle between the right-hand seat 26 and the footrest decreases while the angle between the left-hand seat and footrest increases. When the swing ride is hanging straight down as in FIG. 1, the two angles are the same.

Still referring to FIG. 1, the swing ride 10 incorporates toys in the form of bubble generators shown generally at 42. The bubble generators are mounted in the openings 28*a* of the two handles 28. Each bubble generator includes a trigger 42*a* for activating that generator. Air for energizing each bubble generator is delivered thereto by a tube 44 extending down to a deformable member in the form of a bellows capsule 46, the two bellows capsules being alternately extended and compressed in a reciprocal manner as the hangers 16 swing back and forth as described above. In other words, when the FIG. 1 swings swings to the right as shown in FIG. 4, the left-hand bellows capsule 46 is compressed with the result that a puff of air is delivered via the corresponding tube 44 to the left-hand bubble generator 42. If the rider sitting on the left-hand seat 26 has pulled trigger 42*a* of that bubble generator, bubbles will be emitted from that generator as will be described in more detail later. On the other hand, the right-hand bubble generator 42 in FIG. 1 will not be charged with air from the corresponding bellows capsule 42 because that capsule is being extended as shown in FIG. 4. Therefore, even if the rider sitting in the right-hand seat 26 pulls trigger 42 of the right-hand bubble generator 42, no bubbles will be emitted from that generator.

Of course when the FIG. 1 swing swings to the left, the opposite situation prevails, i.e., the right-hand bellows capsule is under compression so that only the right-hand bubble generator 42 will produce bubbles provided that its trigger 42*a* is pulled by the rider sitting on the right-hand seat 26.

Refer now to FIG. 2 which shows the right-hand bellows capsule 46 in FIG. 1, the left-hand capsule being a mirror image thereof. As shown in FIG. 2, capsule 46 is captured between an undersurface 26*a* of seat 26 and the upper surface 34*a* of footrest 34. More particularly, capsule 46 is formed with a circular flange 46*a* which seats in a circular recess 52 in footrest surface 34*a*. Recess 52 has a circular lip 52*a* which is sized so that when the capsule flange 46*a* is pushed into recess 52, it will snap into place under lip 52*a* thereby anchoring the lower end of the bellows capsule 46.

A similar snap-in connection in provided for the upper end of bellows capsule 46. More particularly, capsule 46 has a domed upper end which seats in a recess 54 in the undersurface 26*a* of seat 26. That end has a flange 46*b* which is engaged by lip 54*a* around the mouth of recess 54 when that end of the bellows capsule is pushed into recess 54. As shown in FIG. 2, a tubular stem 56 extends from the upper end of bellows capsule 46, a hole 58 being provided in the wall of recess 54 to provide clearance for the stem. Stem 56 is adapted to be connected to the lower end of tube 44 so that when the bellows capsule 46 is compressed, air is delivered via tube 44 to the corresponding bubble generator 42.

Refer now to FIGS. 3A and 3B which depict the bubble generator 42 in greater detail. Each generator comprises a housing 62 having a front wall 62*a*, rear wall 62*b* and a pair of opposite side walls 62*c* and 62*d*, a bottom wall 62*e* and a top wall 62*f* part of which is domed at 62*g*. A dimple 64*a* is provided at the top of dome 62*g* and a similar dimple 64*b* is formed in bottom wall 62*e*. These dimples or recesses are adapted to receive bumps or projections 66*a* and 66*b* formed at upper and lower locations in the wall of handle opening 28*a*. When the bubble generator is properly positioned within opening 28*a*, the bumps 66*a* and 66*b* snap into the dimples 64*a* and 64*b* of housing 62 to securely anchor the bubble generator in place as shown in FIG. 1.

As shown in FIG. 3A, the upper end of tube 44 is connected to a tubular stem 68 which extends through dome 62*g* into the interior of housing 62 so that the inner end 68*a* of that stem is close to the centerline of the housing. As best seen in FIG. 3A, the side of housing dome 62g facing stem end 68*a* is cut away to form a large exit opening 72. Also, the housing top wall 62*f* has a semi-cylindrical recess 72*a* in line with opening 72 to define an exit path from the interior of housing 62 which is more or less circular or cylindrical.

Referring now to FIGS. 3A and 3B, the bubble generator 42 also includes the aforesaid trigger 42*a*. This trigger is actually one end of a lever arm 74 whose fulcrum is at a pivot pin 76 extending through the level arm, the opposite ends of the pin being secured to housing front wall 62*a*. The housing is slotted at 75 to provide clearance for the lever arm. Formed at the inner end of lever arm 74 is a ring or annulus 78 having a central opening 78*a* which is appreciably larger than the cross-section of stem 68 but somewhat smaller than the opening 72 in housing 62. Also for reasons that will become apparent, the opposite sides of ring 78 are formed with radial striations 78*b*.

As shown in FIG. 3B, by pulling on the trigger 42*a*, the lever arm 74 may be swung between a lower position shown in phantom in FIG. 3B to an upper position shown in solid lines in that same figure. When the lever aim is in its lower position, the ring 78 at the inner end thereof is immersed in a body of soapy water W that fills a lower volume of container 62 below dome 62*g*. When the lever arm 74 is in its upper position, the ring 78 is positioned between the stem end 68*a* and the dome opening 72 such that the ring opening 78*a* is centered on those two openings. Normally, the lever arm 74 reposes in its lower position shown in phantom in FIG. 3B due to gravity or, if necessary, there may be a suitable spring acting between the lever arm and the housing wall 62*a*.

In any event, when the lever arm 74 is moved from its lower to its upper position, the ring 78 picks up a film of soapy water W which spans the ring opening 78*a* and transports or locates that film directly between stem end 68*a* and dome opening 72. If the corresponding bellows capsule 46 is being compressed at the time by the motion of swing ride 10, a puff of air will be delivered via tube 44 and stem 68 to the film supported by ring 78 causing one or more bubbles B to be ejected from the bubble generator through opening 72 as shown in FIG. 3A. As long as air issues from stem 68, the lever arm 74 may be swung between its two positions to bring successive films of soapy water into position to be expelled as bubbles through the opening 72.

As noted above, ring 78 has radial striations. These facilitate the delivery of soapy water to ring opening 78*a* to maximize the number of bubbles that can be produced each time trigger 42*a* is pulled to raise lever arm 74 to its operative position shown in solid lines in FIG. 3B.

As discussed above, the bubble generator 42 whose bellows capsule 46 is not under compression will not emit bubbles even if its trigger 42*a* is pulled.

The illustrated swing ride 10 may be sold in a knock down condition with the major components of the ride being assembled in the usual way. Once those components have been assembled, the bellows capsule 46 may be snapped into place between the seat structures 26 and the footrest 34 as described above and the tubes 44 may be threaded up through the seat structures to the handle openings 28*a* for connection to the bubble generators 42 after they have been snapped into place in those openings as described above.

While the illustrated swing ride 10 incorporates toys in the form of bubble generators, it should be understood that comparable swings may incorporate other toys which utilize an air pressure differential produced by a deformable member deformed by relatively moving parts of the swing. For example, the toy may comprise a propeller which is rotated periodically by air delivered by bellows capsule 46. Alternatively, the toy may be a whistle or siren which is sounded upon receiving compressed air from the associated collapsing bellows capsule 46. By the same token, swing ride 10 may incorporate a toy which is energized by a negative pressure upon expansion of an associated bellows capsule 46, one example being a balloon which is alternately inflated and deflated by the action of the associated bellows.

It will thus be seen that the objects set forth among those made apparent from the preceding description are efficiently attained and, since certain changes may be made in the above construction without departing from the scope of the invention, it is intended that all matter contained in the above description or shown in the accompanying drawings shall be interpreted as illustrative and not in a limiting sense.

What is claimed is:

1. A swing ride capable of swinging motion about an elevated support, said swing ride including:

first and second parts which move toward and away from one another during the swinging motion of the swing;

a deformable chamber extending between said parts and which is alternately compressed and expanded during the motion of the swing;

a fluidically operated toy connected to one of said parts, and a fluid conduit connected between said deformable chamber and said toy that conducts fluid bet ween said deformable chamber and said toy so that said toy is energized by a change in fluid pressure from said deformable chamber caused by the swinging motion of said swing ride.

2. The swing ride defined in claim 1 wherein the toy includes a trigger which activates the toy after it is energized.

3. The swing rid e defined in claim 1 wherein said first part is a platform, the second part is a hanger pivotally connected to the platform and the deformable chamber is a bellows capsule connected between the platform and the hanger, said bellows capsule having an outlet, and the conduit is a tube extending between said outlet and said toy.

4. The swing ride defined in claim 3 wherein the bellows capsule has opposite ends configured to interfit with structures connected to said platform and said hanger, respectively.

5. The swing ride defined in claim 1 wherein said toy is a bubble generator which can produce bubbles upon compression of the deformable chamber connected thereto by said conduit.

6. The swing ride defined in claim 5 wherein the bubble generator comprises:

a container adapted to contain a supply of a film-forming liquid up to a selected level in the container;

a tube extending from said conduit to the interior of said container above said level;

means defining an opening in said container above said level and spaced opposite said tube, a ring movable within said container between a first position in which the ring is below said level and a second position in which the ring is disposed above said level between said tube and said opening, and means accessible from without the container for moving said ring between said two positions.

7. The swing ride defined in claim 6 wherein said moving means comprise a lever having the one end extending outside of the housing, a second end attached to said ring and a fulcrum at a pivotal connection to the housing.

8. The swing ride defined in claim 7 wherein said ring comprises an annulus having inner and outer edges and radial striations extending between said edges.

* * * * *